US005368282A

United States Patent [19]

Mortimer et al.

[11] Patent Number: 5,368,282

[45] Date of Patent: Nov. 29, 1994

[54] INDUCTION FURNACE PROVIDING CONTROLLED ESCAPE OF SUPERHEATED METAL

[75] Inventors: John H. Mortimer, Mt. Laurel; Robert C. Turner, Edgewater Park, both of N.J.

[73] Assignee: Inductotherm Corp., Rancocas, N.J.

[21] Appl. No.: 88,064

[22] Filed: Jul. 6, 1993

[51] Int. Cl.[5] ..... C21B 13/00; C21B 15/00

[52] U.S. Cl. ..... 266/44; 75/10.14; 373/158; 373/160

[58] Field of Search ..... 266/280; 373/158, 160; 75/10.14

[56] References Cited

U.S. PATENT DOCUMENTS

| | | | |
|---|---|---|---|
| 1,823,873 | 9/1931 | Brace | 373/158 |
| 1,922,034 | 8/1933 | Feehan | 373/160 |
| 2,871,533 | 2/1959 | Swainson | 75/10.65 |
| 3,328,017 | 6/1967 | Conner | 266/280 |
| 3,435,878 | 4/1969 | Howard et al. | 164/51 |
| 3,484,840 | 12/1969 | Spoth et al. | 13/27 |
| 3,582,528 | 6/1971 | Seale et al. | 13/27 |
| 3,598,168 | 8/1971 | Clark | 164/51 |
| 3,682,458 | 8/1972 | Piwonka et al. | 266/33 R |
| 4,790,874 | 12/1988 | Lirones | 75/10.14 |

*Primary Examiner*—Peter D. Rosenberg
*Attorney, Agent, or Firm*—Seidel, Gonda, Lavorgna, & Monaco

[57] ABSTRACT

An induction furnace which provides a controlled escape pathway for superheated metal is disclosed. The induction furnace comprises a base layer of refractory material in the bottom of the furnace vessel. The base layer of refractory is composed of a first refractory having a maximum operational temperature and a second refractory having a maximum operational temperature lower than that of the first refractory. At least a portion of the second refractory is arranged in a contiguous zone through the thickness of the base layer. The base layer supports a packed granular refractory lining that extends up along the side wall of the vessel. In one embodiment of the invention, the base layer takes the form of a means for pushing out the packed granular lining from the furnace. The pusher means is arranged for axial movement within the furnace in response to a driving force applied from below the base layer. The pusher means contains the contiguous zone of the second refractory. In another embodiment of the invention, the base layer is comprised of tiers of refractory, each tier comprising a portion of the second refractory in the same location as in each other tier forming a contiguous zone of the second material. The failure of the second refractory zone allows the superheated metal to escape through the base of the furnace in a controlled manner at the preselected location of the second zone.

9 Claims, 3 Drawing Sheets

INDUCTION FURNACE PROVIDING CONTROLLED ESCAPE OF SUPERHEATED METAL

FIELD OF THE INVENTION

The present invention pertains to induction furnace design. The invention provides an induction furnace having a controlled escape pathway for molten metal in the event of a failure in the refractory lining of the furnace when superheating metal. The controlled escape of the superheated metal eliminates the potential for severe damage to the furnace which might otherwise occur if the refractory lining of the furnace failed in an uncontrolled manner.

BACKGROUND OF THE INVENTION

An induction furnace employs electromagnetic energy to induce electrical currents within a charge of metal or metal alloy. The electrical resistance of the metal produces heat as a natural consequence of the induced currents flowing in the metal. The combination of applied electrical power and frequency can be chosen to induce sufficient heat within the metal to cause it to melt, providing a molten liquid which can be poured into molds or otherwise used to produce a wide variety of metal products.

The basic elements of an induction furnace include an electromagnetic induction coil, a vessel having a lining of refractory material, and a support structure for the coil and vessel.

The coil must comprise an electrical conductor of sufficient size and current capacity to produce the magnitude of electromagnetic flux necessary to induce large currents in the metal charge. Often, the coil must be cooled to prevent it from being damaged by overheating. A common cooling technique is to fabricate the coil from hollow tubing through which water is passed to carry away the heat. The water-cooled induction coil is usually either very close to or in contact with the exterior of the refractory material containing the metal charge.

Within the furnace is a vessel which is lined with refractory material to withstand the extreme temperatures associated with molten metals. Refractory material can withstand extremely high temperatures without deformation. The refractory lining nearest the molten metal is generally a packed granular material. The inner surface of the packed granular lining is the crucible. The crucible is the container for the melt. In smaller furnaces, the crucible may be a preformed refractory container around which the packed granular lining is rammed into place. In larger furnaces the packed granular lining material packed into the furnace is the crucible. It becomes fused on the interior surface after contact with molten metal the first time the furnace is used. A solid refractory material may also be used to line and insulate the bottom of the furnace vessel.

In operation, the interior surface of the refractory lining that contacts the molten metal becomes sintered and brittle because of the extreme temperatures to which it is exposed. As the furnace is used repeatedly, the refractory expands and contracts in response to the heating and cooling cycles. Cracks form in the refractory, permitting small amounts of molten metal to migrate into the granular material.

The crucible refractory and lining typically is replaced after a preselected number of melting cycles to prevent failures of the furnace. However, there is always the danger that an unexpected failure can occur. This danger is particularly acute when the furnace is used to superheat the molten metal. Superheated metal can accelerate the breakdown of the refractory lining of the furnace. If a failure occurred in the wall of the crucible lining such that superheated molten metal within the crucible were able to flow through the refractory and reach the water-cooled induction coil, a catastrophic water-molten metal explosion could result.

There is a need to provide for a controllable failure mode in induction furnaces of this type so that, if a failure does occur in the furnace lining, it will occur in such a manner that runout of molten metal will occur in a preselected location away from the induction coil, and away from operating personnel and equipment. The present invention fills that need.

SUMMARY OF THE INVENTION

The present invention is an induction furnace having a base layer of refractory material in the bottom of the vessel within the furnace and a crucible lining of packed granular refractory material. The base layer supports the packed granular crucible lining. The base layer of refractory comprises high and low temperature refractory materials. At least a portion of the low temperature refractory material is arranged to form a contiguous zone of low temperature refractory through the thickness of the base layer. An induction heating coil is arranged around the side wall of the vessel.

In one embodiment of the invention, the base layer of the induction furnace refractory lining is a pusher block for pushing out the packed granular crucible lining from the furnace. The pusher block generally conforms to the interior shape and size of the furnace interior and moves axially up through the furnace in response to a force applied from below. The pusher block function is to eject the used granular crucible lining material from the interior of the furnace. When the base layer of the furnace is configured as a pusher block, the pusher block comprises high and low temperature refractory material. The low temperature refractory is arranged within the pusher block to form the contiguous zone of low temperature material that extends through the thickness of the layer.

In another embodiment of the invention, the base layer of the refractory lining the furnace vessel is composed of numerous elements of high and low temperature refractory. The elements, or "bricks," are arranged in one or more tiers in the bottom of the furnace vessel. A portion of each tier is comprised of low temperature refractory, this portion of each tier being in the same location within the tier as in each other tier. In this way a contiguous zone of low temperature refractory extending through the thickness of the base layer is formed.

In all embodiments of the invention, the low temperature refractory is selected to have a failure temperature lower than that of the high temperature refractory used in the furnace. In the event the metal in the crucible becomes super-heated such that refractory integrity is threatened, the low temperature refractory is the first to fail. The failure of the contiguous zone of low temperature refractory causes a void to open through the base layer, allowing the collapse of the packed granular refractory material supported by that part of the base layer. The super-hot metal is thereby permitted to make a controlled escape through the void in the base layer.

DESCRIPTION OF THE DRAWINGS

For the purpose of illustrating the invention, there are shown in the drawings forms which are presently preferred; it being understood, however, that this invention is not limited to the precise arrangements and instrumentalities shown.

DESCRIPTION OF THE INVENTION

Figure 1:
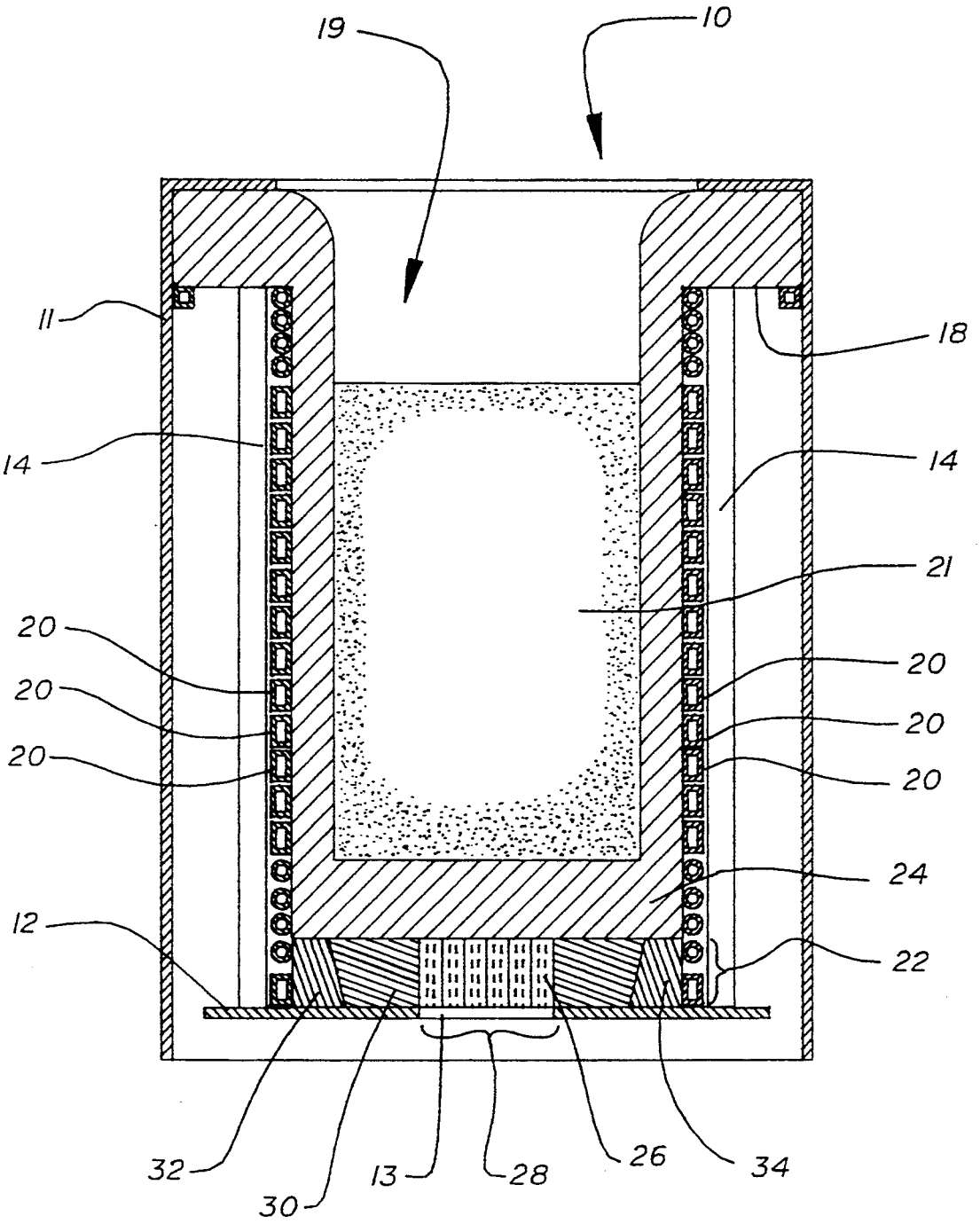
FIG. 1 is a vertical longitudinal section of an induction furnace according to one embodiment of the invention, illustrating the base layer refractory configured as a means for pushing out the packed granular refractory furnace lining.

Referring to the drawings, wherein like numerals indicate like elements, FIG. 1 illustrates an induction furnace 10 which embodies the present invention having an arrangement of high and low temperature refractory material in the base layer. The details of the supporting structure of the furnace are not crucial to the invention and may vary from one furnace to another, and therefore such details are not shown here.

The induction furnace 10 of FIG. 1 is enclosed by a steel shell 11. Within the steel shell 11 is a bottom plate 12 having an orifice 13 located substantially at its center. The bottom plate 12 supports the interior structure of the furnace. Shunts 14 serve to direct electromagnetic flux generated by an induction coil 20 in a known manner, and also serve to support the upper interior rim 18 of the furnace. The water-cooled induction coil 20 surrounds a vessel 19 containing a refractory lining 24 and molten metal 21.

The furnace vessel 19 is lined with refractory material. A base layer 22 of refractory rests upon the bottom plate 12. The base layer 22 supports a packed granular lining 24 of high temperature refractory which extends upward along the sides of the vessel 19.

The base layer 22 of refractory is composed of material having different maximum operating temperatures. The refractory with the lower operating temperature—low temperature refractory 26—is arranged in a contiguous zone 28 substantially in the center of the base layer 22. The contiguous zone 28 extends through the entire thickness of the base layer 22. The remainder of the base layer 22 is composed of the refractory with the higher maximum operating temperature, i.e., the high temperature refractory 30.

The base layer 22 of the furnace 10 is configured as a pusher block base, that is, a movable base which can be pushed up through the furnace in known manner for dislodging and ejecting the packed granular refractory lining 24 when it requires removal. In this embodiment of the invention, the pusher block base layer 22 is composed of both high and low temperature refractory material. The pusher block base layer 22 can have beveled ends which rest upon complementary beveled ends of rim blocks 32, 34. The rim blocks 32, 34 are composed of high temperature refractory material. The rim blocks 32. 34 are not part of the movable pusher block, but comprise part of the insulating layer of refractory at the bottom of the furnace 10.

Refractory materials are capable of withstanding temperature extremes beyond any to which common metals, wood, resins, or plastics can be safely exposed. Some examples of refractory materials employed within induction furnaces are magnesia, alumina, lime, silica sand and carborundum. Each material has a different maximum operating temperature.

The packed granular refractory lining 24 must withstand the highest temperature to which the molten metal 21 will be heated in the furnace 10. The refractory material comprising the base layer 22 must also be selected to withstand extreme temperatures produced during the process. Choosing a material for the base layer normally requires the identification of the maximum temperature to which the base layer would be exposed in normal operation. After provision for a safety factor reasonably above that temperature, the type of refractory material may be selected.

An operational hazard exists, however, when the temperature of the molten metal 21 is allowed to reach or exceed the maximum operating temperature of the crucible refractory lining material 24. The breakdown of the refractory lining 24 can permit the molten metal 21 to migrate through the lining 24 to the water-cooled induction coil 20. An extremely dangerous and damaging water-molten metal explosion can be the result.

The present invention provides a mechanism by which the molten metal 21 can be allowed to escape the furnace 10 before a more serious result occurs. Referring again to FIG. 1, base layer 22 is a combination of two refractory materials. The materials are selected to have different maximum operational temperatures. Both operational temperatures must be substantially above that to which the refractory materials will be exposed in the normal process of melting the metal to be processed in the furnace. The selection of the lower temperature material 26 must provide a failure temperature which, though safely above that to which it is normally exposed in the furnace, is lower than the failure temperature of both the packed granular lining 24 and the higher temperature refractory 30 in the base layer 22. The calculation of that temperature must account for the thermal gradient across the distance from the bottom of the molten metal mass 21 through the packed granular lining 24 to the base layer 22 of refractory. It must also account for the rate at which the temperature of the molten metal 21 might rise if the induction coil 20 is allowed, by whatever calamity, to operate at full capacity without regulation. The superheated metal 21 must be allowed to escape before it reaches the failure temperature of the high temperature refractories 24, 30.

Figure 2:
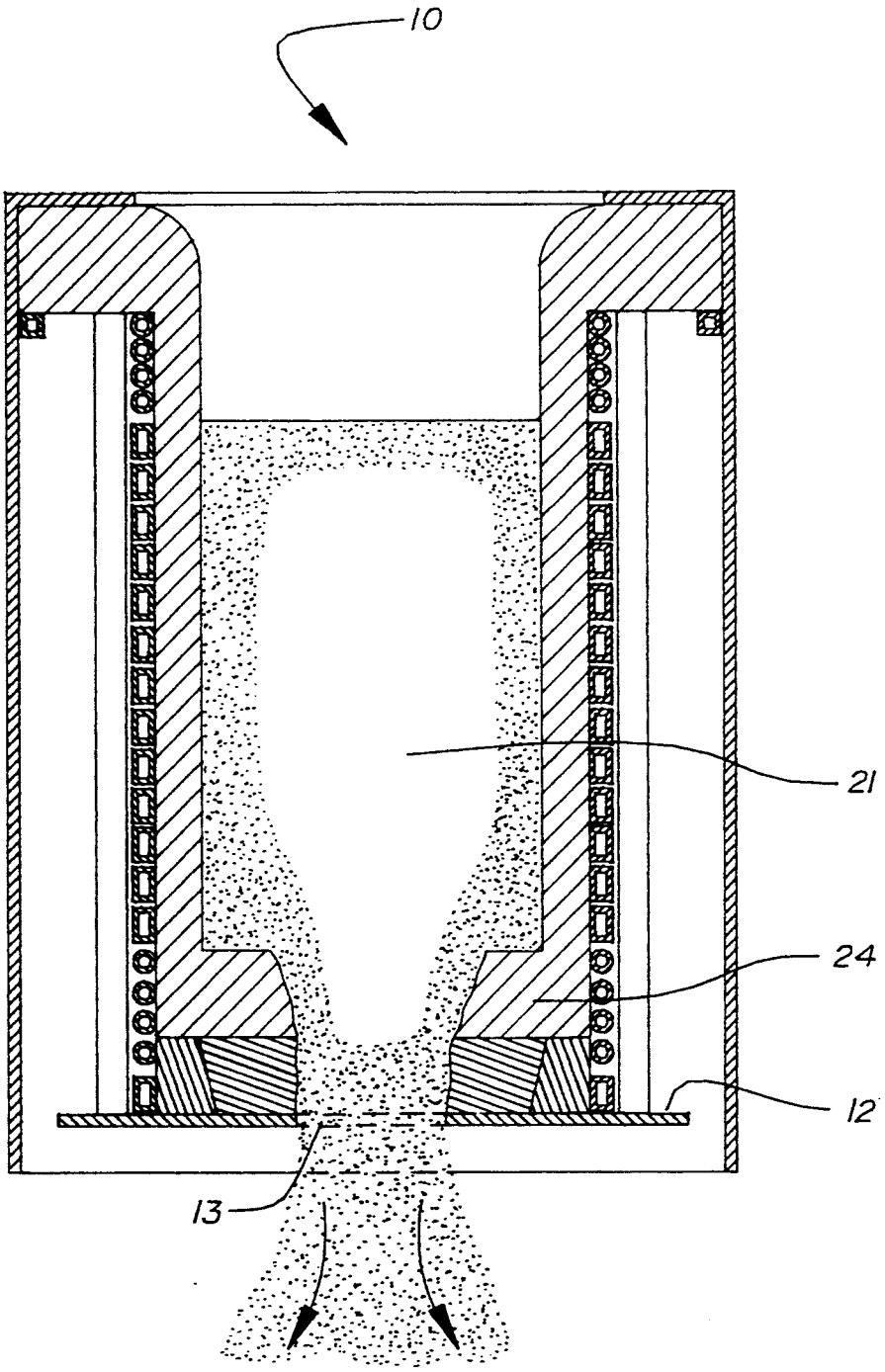
FIG. 2 is a vertical longitudinal section of the induction furnace of FIG. 1 illustrating the controlled runout of superheated metal.

The low temperature refractory is arranged in a contiguous zone 28 within the base layer 22. The remainder of the base layer 22 is formed of high temperature refractory 30. In the event the temperature of the molten metal 21 causes the temperature of the low temperature refractory 26 to exceed its maximum rating, the low temperature refractory zone 28 fails first as the molten metal 21 temperature increases. As the low temperature refractory zone 28 fails, the support for the packed granular lining 24 is removed and the lining 24 collapses into and through the void left by the failed low temperature refractory zone 28. The void thus created in the bottom of the furnace lining 24 permits the superheated metal to make a controlled escape from the furnace 10 before a potentially more disastrous failure of the high temperature refractory material 24 adjacent the induction coil can occur. FIG. 2 illustrates the controlled failure of the furnace 10 shown in FIG. 1, wherein the low temperature refractory zone has failed and a segment of the packed granular lining 24 has collapsed through the resulting void. The super-hot metal 21 is permitted to escape through the void in the refractory lining 24 and the orifice 13 in the bottom plate 12.

Referring back to FIG. 1, the low temperature zone 28 is preferably located substantially in the center and extends through the entire thickness of the base layer 22. Locating the zone 28 at the center of the base layer 22 provides the maximum separation distance between the site where the molten metal 21 escapes the furnace 10 and the lower extremity of the induction coil 20, which must be protected from exposure to the molten metal 21. Other locations within the base layer 22 are possible, however, provided that the induction coil 20 is safeguarded.

The bottom plate 12 of the furnace 10 is preferably provided with an orifice 13 through which molten metal can escape if runout occurs. In the absence of an orifice, molten metal would be temporarily contained by the bottom plate 12, at least until the molten metal 21 was able to melt through the plate 12. Such a result is undesirable, since it tends to defeat the advantage gained by employing the low temperature zone 28. The orifice 13 should be substantially the same size as the low temperature refractory zone 28 in the base layer 22. It may be covered by a plate of another metal, such as aluminum, which may support the weight of the refractory above but also melt quickly in the event an emergency molten metal escape is necessary.

Figure 3:
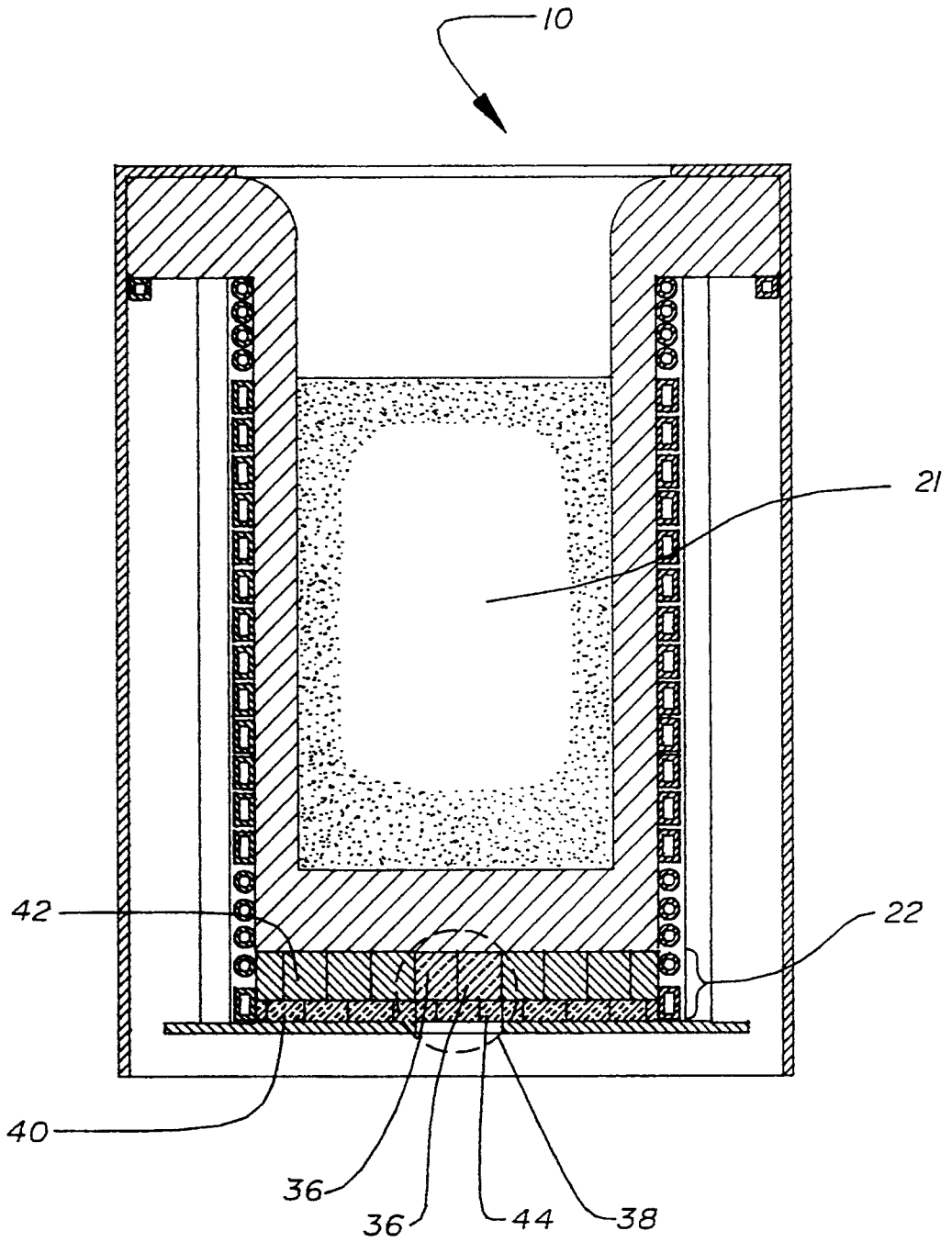
FIG. 3 is a vertical longitudinal section of an induction furnace according to an alternative embodiment of the invention, employing a plurality of tiers of refractory elements as the base layer.

Another embodiment of the present invention is illustrated in FIG. 3. The structural characteristics of the furnace are unchanged from the furnace 10 of FIG. 1. The arrangement of refractory material in the base layer 22 represents an adaptation of a common furnace lining technique to include the present invention.

The base layer 22 of refractory in the furnace 10 of FIG. 2 is comprised of a plurality of individual refractory elements, commonly termed "bricks," arranged in tiers at the bottom of the furnace 10. The number of tiers of refractory depends upon the expected temperatures inside the furnace 10, the size of the bricks, and the protective insulating characteristics of the refractory, material used. FIG. 3 shows two tiers 40, 42 of refractory bricks, though other configurations are possible. The lower tier 40 is composed entirely of low temperature refractory. The upper tier 42 is composed of both high and low temperature refractory material. The low temperature refractory bricks 36 in the upper tier 42 are centrally located within the upper tier 42. Taken in conjunction with the low temperature bricks 44 in the lower tier 40 directly below, a contiguous zone 38 of low temperature refractory exists through the thickness of the base layer 22. The failure of this zone 38 of low temperature refractory in a superheating accident provides a controlled escape path for the super-hot metal 21 contained in the furnace 10.

No matter how many tiers are required, the present invention permits the construction of a base layer 22 of refractory which will enable the escape of superheated molten metal 21 from the furnace 10 before major damage can occur. Within each tier of refractory, the low temperature refractory bricks 36 are located substantially at the center of the tier. If many tiers are employed, the low temperature bricks 36 stack up upon each other forming a contiguous zone 38 of low temperature refractory through the entire thickness of the base layer 22. If only one tier of refractory is used, the low temperature material is located substantially in the center of the tier surrounded by high temperature refractory.

In the various embodiments of the present invention, the contiguous zone of low temperature refractory forms a shaft of low temperature material standing within the base layer. The geometric shape of the shaft in transverse cross section may vary. It may have a circular, rectangular, triangular or other appearance. It could conceivably have a toroidal shape, with low temperature material surrounding a high temperature material core, though this form seems unnecessarily complex. In a larger furnace it may be useful to provide more than one zone of low temperature refractory in the base layer to provide multiple emergency runout pathways.

The surface area of the contiguous zone of low temperature refractory in the base layer of each embodiment of the present invention determines the rate at which the superheated metal may escape the furnace. No preferred dimension can be determined which is suitable for all furnaces and purposes. For each furnace, the dimension of the planned escape orifice represented by the zone of low temperature refractory must be chosen based upon a number of factors, among them, the type of metal processed in the furnace, the melting temperature of the metal, the rate at which the temperature of the melt would increase in a superheating accident, the failure temperature of the high temperature refractory material in the furnace, and the volume of melted metal contained in the furnace.

There are practical limits on the size of escape orifice defined by the contiguous zone of low temperature refractory in the base layer of the furnace. One limit is the need to protect the lower extremities of the induction coil from contact with molten metal. Another is the capacity of whatever emergency runout collection apparatus is provided beneath the furnace. It is generally more desirable for the escape pathway to be smaller rather than larger. The purpose of the invention is to provide a controlled escape pathway for superheated metal through the bottom of an induction furnace. The larger the escape pathway is, the less controlled is the escape of molten metal through the pathway.

The present invention may be embodied in other specific forms without departing from the spirit or essential attributes thereof and, accordingly, reference should be made to the appended claims, rather than to the foregoing specification, as indicating the scope of the invention.

We claim:

1. An induction furnace comprising a vessel having a bottom surface and a side wall, a base layer of refractory material arranged on the vessel bottom adjacent to and supporting a crucible lining of packed granular refractory material, said base layer being composed of a first refractory material having a maximum operational temperature and a second refractory having a maximum operational temperature lower that that of the first refractory, a portion of said base layer comprising the second refractory material and the remainder of said base layer comprising the first refractory material, said base layer having a preselected thickness, at least a portion of the second refractory material in the base layer being arranged in a contiguous zone substantially through the thickness of the base layer, and an induction heating coil arranged around the side wall of the vessel.

2. A lining for an induction furnace, said furnace having a vessel with bottom surface therein, comprising a base layer of refractory material arranged on the bottom surface of the vessel, said base layer being adjacent to and supporting a packed granular crucible lining composed of refractory material, said base layer being composed of a first refractory material having a maximum operational temperature and a second refractory having a maximum operational temperature lower that that of the first refractory, said base layer having a preselected thickness, and said base layer having at least a portion of the second refractory material arranged in a contiguous zone substantially through the thickness of the layer.

3. The induction furnace lining of claim 2, the base layer of refractory material comprising a pusher means for pushing out the packed granular crucible lining from the furnace, said pusher means substantially conforming to the geometric shape and dimension of a transverse cross-section of the furnace interior, said pusher means being arranged for axial movement within the furnace when driven by axial force applied to it from below the base layer, said pusher means comprising the first and second refractory materials and containing the contiguous zone of the second refractory material substantially through the thickness of the pusher means.

4. The induction furnace lining of claim 2, the base layer of refractory material being arranged in a plurality of tiers, each tier comprising at least a portion of the second refractory material arranged in substantially the same location within that tier as in each other tier, said arrangement forming the contiguous zone of second refractory material substantially through the thickness of the base layer.

5. The induction furnace lining of claim 4, the whole of at least one tier comprising the second refractory material, and that portion of each other tier not within the contiguous second refractory zone comprising the first refractory material.

6. The induction furnace lining of claim 2, 3, 4, or 5, the second refractory material in the base layer being chosen to allow physical failure at a preselected temperature and the first refractory employed being unaffected and stable at this temperature, the failure of the contiguous zone of second refractory causing a void in the base layer of refractory, said void being limited to the location of the contiguous zone of second refractory, the formation of said void removing support from a portion of the packed granular crucible lining, allowing collapse of the unsupported portion of the packed granular lining into the void, and permitting the controlled runout of super-hot melt through the bottom of the furnace.

7. An induction furnace having a lining comprising a base layer of refractory material, said base layer being adjacent to and supporting a packed granular refractory material lining, said base layer being composed of a first refractory material having a maximum operational temperature and a second refractory having a maximum operational temperature lower that that of the first refractory, said base layer having a preselected thickness, a portion of said base layer comprising the second refractory material and the remainder of said base layer comprising the first refractory material, the second refractory material being arranged in a contiguous zone substantially through the thickness of the base layer and the remainder of the base layer comprising the first refractory material, said base layer comprising a pusher means for pushing out the packed granular lining from the furnace, said pusher means substantially conforming to the geometric shape and dimension of a transverse cross-section of the crucible interior, said pusher means being arranged for axial movement within the furnace when driven by axial force applied to it from below the base layer, the second refractory material in the base layer pusher means being chosen to allow physical failure at a preselected temperature and the first refractory employed being unaffected and stable at this temperature, the failure of the contiguous zone of the second refractory causing a void in the base layer of refractory, said void being limited to the location of the contiguous zone of second refractory, the formation of said void removing support from a portion of the packed granular crucible lining, allowing collapse of the unsupported portion of the packed granular lining into the void, and permitting the controlled runout of super-hot melt through the bottom of the furnace.

8. An induction furnace having a lining comprising a base layer of refractory material, said base layer being adjacent to and supporting a packed granular refractory material lining the interior of the furnace, said base layer being composed of a first refractory material having a maximum operational temperature and a second refractory having a maximum operational temperature less than that of the first refractory material, said base layer having a preselected thickness, said base layer being arranged in a plurality of tiers comprising solid refractory material elements, each tier comprising at least a portion of the second refractory arranged in substantially the same location within that tier as in each other tier, said arrangement forming a contiguous zone of second refractory material substantially through the thickness of the base layer, the second refractory material in the base layer being chosen to allow physical failure at a preselected temperature and the first refractory employed being unaffected and stable at this temperature, the failure of the contiguous zone of second refractory leaving a void in the base layer of refractory, said void being limited to the location of the contiguous zone of second refractory, the formation of said void removing support from a portion of the packed granular crucible lining, allowing collapse of the unsupported portion of the packed granular lining into the void, and permitting the controlled runout of super-hot melt through the bottom of the furnace.

9. A method for providing controlled escape of super-hot metal from an induction furnace comprising the steps (a) constructing a base layer of refractory material in the bottom of an induction furnace, said base layer comprising first and second refractory materials, (b) choosing the second refractory material of the base layer to have a physical failure temperature at a preselected value, that value being substantially lower than the failure point of the first refractory material of the base layer, (c) arranging the refractory material of the base layer such that a contiguous zone of the second refractory material is formed substantially through the thickness of the layer, (d) supporting upon the base layer a packed granular crucible lining of refractory material, whereby, in the event that super-hot metal in the crucible causes the failure of the contiguous zone of second refractory material in the base layer below the crucible lining, a hole is formed through the contiguous second refractory zone portion of the base layer, permitting the collapse of the packed granular lining supported by the base layer, thereby allowing the super-hot melt to make a controlled escape from the furnace through the hole.

* * * * *